US005704561A

United States Patent [19]

Ansén et al.

[11] Patent Number: 5,704,561

[45] Date of Patent: Jan. 6, 1998

[54] WEAR-RESISTANT HARD-SURFACING FOR THE ROLLS OF HIGH-PRESSURE ROLL PRESSES FOR SIZE REDUCTION OF GRANULAR MATERIAL

[75] Inventors: Jakob Ansén, Köln; Frank Fischer-Helwig, Hoffnungsthal; Ludger Alsmann, Köln; Michael Wollner, Gummersbach, all of Germany

[73] Assignee: Deutz AG, Cologne, Germany

[21] Appl. No.: 523,748

[22] Filed: Aug. 28, 1995

[30] Foreign Application Priority Data

Sep. 5, 1994 [DE] Germany ..... 44 31 563.5

[51] Int. Cl.[6] ..... B02C 4/00

[52] U.S. Cl. ..... 241/293; 492/30

[58] Field of Search ..... 492/30; 241/293; 219/121.11, 121.13, 121.45; 419/10, 1, 47; 228/185, 114.5, 107, 177

[56] References Cited

U.S. PATENT DOCUMENTS

| | | | |
|---|---|---|---|
| 2,792,183 | 5/1957 | Fasching et al. | 241/293 |
| 3,599,306 | 8/1971 | Brafford | 429/30 |
| 3,859,701 | 1/1975 | Huber | 492/30 |
| 4,114,322 | 9/1978 | Greenspan | 241/293 |
| 4,617,709 | 10/1986 | Gundlach | 241/293 |
| 4,984,488 | 1/1991 | Lunde et al. | 228/185 |
| 5,267,398 | 12/1993 | Hall | 29/898.041 |

FOREIGN PATENT DOCUMENTS

| | | | |
|---|---|---|---|
| 0 443 195 A1 | 12/1990 | Germany . | |
| 4132 474 A1 | 5/1991 | Germany . | |
| 1162453 | 7/1986 | Japan | 492/30 |

*Primary Examiner*—David P. Bryant
*Assistant Examiner*—Marc W. Butler
*Attorney, Agent, or Firm*—Hardaway Law Firm, P.A.; Charles L. Schwab

[57] ABSTRACT

The rolls of high-pressure roll presses for the compressive size reduction of granular material are hard surfaced with nub pins which are wear-resistant and suitable for autogenous wear protection. The nub pins, which have a long potential service life even under the action of high compressive loads, have a radially inner pin part (13) which is easily welded to the roll surface (12) and a radially outer harder pin part (14) protectively covering the radially inner pin part.

13 Claims, 1 Drawing Sheet

WEAR-RESISTANT HARD-SURFACING FOR THE ROLLS OF HIGH-PRESSURE ROLL PRESSES FOR SIZE REDUCTION OF GRANULAR MATERIAL

TECHNICAL FIELD

This invention relates to a wear-resistant hard-surfacing for the rolls of high-pressure roll presses for the size reduction of granular material, having a multitude of outwardly projecting nub pins welded onto the roll surface at intervals from one another, which nub pins form between themselves pockets for the accommodation of compacted fine granular material.

INFORMATION DISCLOSURE STATEMENT

In roll crushers and roll grinders, brittle grinding feed is drawn into the roll nip formed at the separating space between two rotatably supported counter-rotatable rolls and there subjected to a compressive size reduction. Also known is so-called "attrition" size reduction in the roll nip a high-pressure roll press, in which the individual particles of the grinding feed drawn into the roll nip by means of friction are crushed against one another with the application of an extremely high pressure in a bed of material, that is, in a pile of material pressed together between the two roll surfaces. It is obvious that the roll surfaces in such a case are subjected to extraordinarily severe loading and to severe wear.

It is therefore known to make the surfaces of attrition size-reduction roll presses wear-resistant by welding to the roll surfaces a multitude of profiles, such as prefabricated pin-shaped nub pins, which project outward the roll surface to such a height, and are arranged at such close intervals to one another, that in operation of the roll press the interstices or pockets between the nub pins remain filled with the compressed fine-grained feed material, which forms an a autogenous wear protection for the roll surfaces such as is disclosed in German patent document EP-A 0 443 195, FIG. 4 and 5. The welding on of the nub pins in a manner simple from the standpoint of manufacturing engineering is, however, possible only with the aid of a so-called stud welding gun that lifts the pin from the workpiece via a lifting magnet, in which process an arc is produced that fuses the pin end and the parent material, after which the pin is pressed into the liquid weld pool. The nub pins are thus bonded by fusion of the contact surfaces and pressing without any welding filler metal. The welding on of such prefabricated nub pins is, however, possible only in the case of a pin material that can be welded on the service life of such nub pins used on the extraordinarily severely loaded roll surfaces of attrition size-reduction roll presses is therefore limited. In order to increase the pin strength, it has already been proprosed in German patent document DE-A 41 32 474 insert the nub pins into blind holes of the roll body of attrition size-reduction roll presses in order to allow them to protrude form the holes of the roll body in hedgehog fashion. From the standpoint of manufacturing engineering, however, it is relatively expensive to press, weld, braze, screw or shrink-fit the nub pins into suitable blind holes of the roll body or to anchor them fast in the roll body by another joining method. Also, it can be troublesome, in case of wear, to remove the nub pins from their blind holes and replace them with new pins.

OBJECTS AND SUMMARY OF THE INVENTION

It is an object of the invention to create hard surface nub pins for the rolls of high-pressure roll presses for the compressive size reduction of granular material, the nub pins having autogenous wear resistance and a long service life even under the action of high compressive loads.

In order to provide hard-surfacing for the rolls of high-pressure roll presses for the size reduction of granular material, two-part nub pins are welded onto the roll surface, each nub pin being made up of a radially inner pin part easily weldable to the roll surface and a radially outer harder pin part, protectively covering the inner pin part. The radially outer pin part consists of a hard material and is materially bonded to the radially inner pin part. The radially outer pin part can advantageously consist of sintered hard alloy and/or of ceramic material and/or of hard-surfacing welding material, and it exhibits a hardness of more than 52 HRC (Rockwell C hardness test), in particular more than 58 HRC. The very hard material of the radially outer pin part increases the potential service life of the attrition size-reduction roll press roll hard-surfaced in a grid pattern in accordance with the invention.

The radially outer pin part can be materially bonded to the radially inner pin part by means of friction pressure welding or arc welding. The radially outer pin part can, however, also be fabricated by powder-metallurgical methods and materially bonded to the radially inner pin part by sintering. In either case, it is advantageous from the standpoint of manufacturing engineering if the radially outer pin part and he radially inner pin part are a prefabricated unit that can then be easily welded to the roll surface via the radially inner pin part. Fabrication steps such as boring, pressing of nub pins into holes, etc., are avoided in the hard-surfacing in accordance with the invention.

BRIEF DESCRIPTION OF THE DRAWINGS

The invention and its further features and advantages are explained in more detail on the basis of the exemplary embodiments illustrated in the drawings, in which.

DETAILED DESCRIPTION OF THE DRAWINGS

Figure 1:
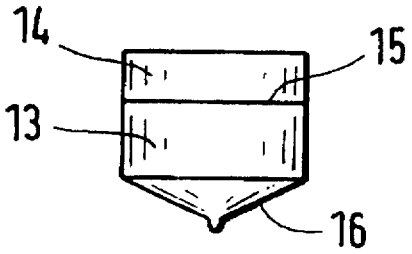
FIG. 1 shows a prefabricated two-part nub pin in accordance with the invention for the hard-surfacing of compressive size reduction press rolls and FIG. 2 is a vertical section transverse to the rotation axis of a roll press roll hard-surfaced in grid fashion in accordance with the invention with the use of the nub pins of FIG. 1.
Figure 2:
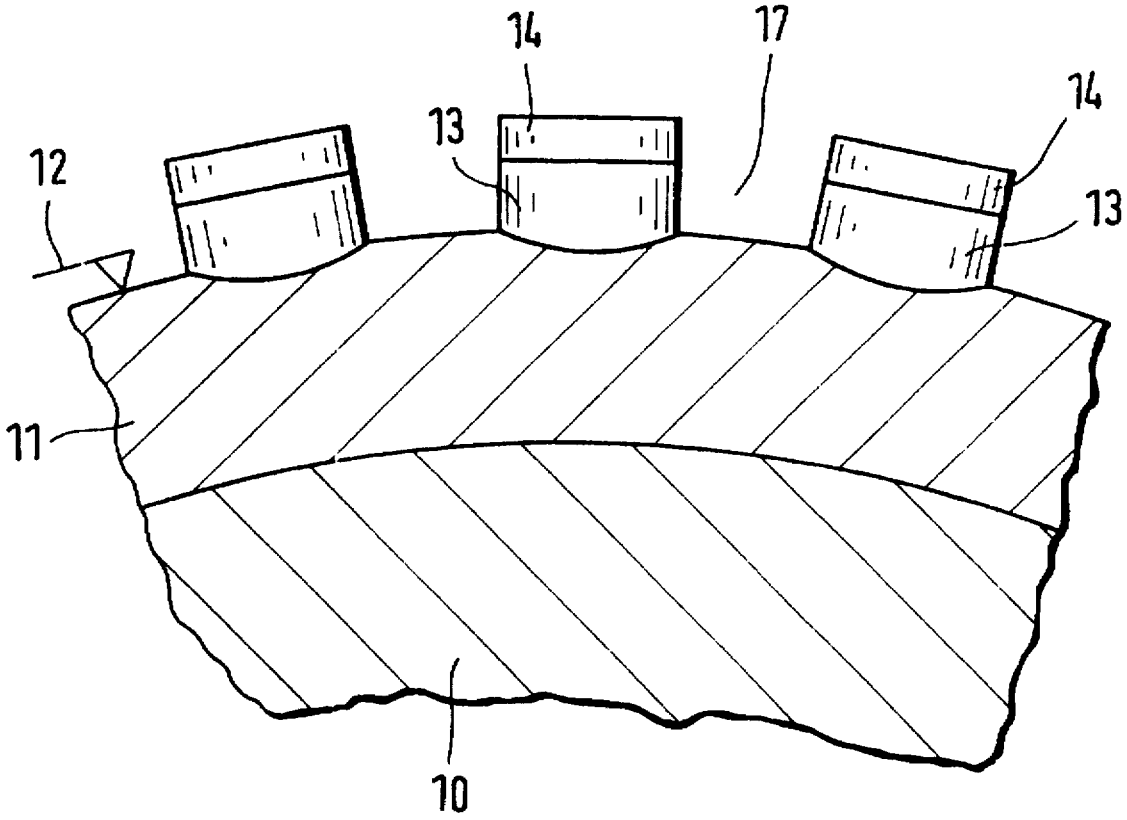

FIG. 1 shows a prefabricated cylindrical two-part nub pin before the pin is used for hard-surfacing of the attrition size-reduction roll press roll of FIG. 2. According to FIG. 2, the press roll consists of a roll body (10) to which a roll shell (11) forming the outer peripheral region is removably attached. On the surface (12) of the roll shell a multitude of two-part pins as shown in FIG. 1 are welded at predetermined intervals from one another. The metallic roll shell (11) can be made up of a self-contained riding ring or of individual segments removably secured to the roll body (10). The two-part nub pins can also be welded directly to a roll body (with no roll shell).

As shown in FIG. 1, each of the prefabricated nub pins consists of a radially inner (lower) pin part (13) easily weldable to the roll surface (12) and of a radially outer pin part (14) protectively covering the radially inner pin part (13), the radially outer pin part consisting of hard materials and being materially bonded to the radially inner pin part (13). The radially outer pin part (14) can consist of sintered hard alloy and/or ceramic material or, for example, can also be fabricated by powder-metallurgical methods and sintered onto the radially inner pin part (13). Friction pressure welding with rotation of at least one of the pin parts, arc welding, including plasma arc welding, etc., can be employed as joining technique for the material bonding of the radially outer pin part (14) to the radially inner pin part (13). The boundary surface (15) between lower pin part (13) and upper pin part (14) need not be plane-parallel to the radially outwardly lying surface of the pin; it can instead be made for example, conical, similarly to the lower surface (16) of the lower pin part (13). The two-part nub pins of FIG. 1 are advantageously welded to the roll surface (12) by the stud welding method. For this purpose, the two-part welding gun is then placed on the roll surface (12). A lifting nub pin is inserted in the holder of a stud welding gun and the magnet present in the welding gun then lifts the two-part nub pin away from the roll surface (12), an arc being produced by means of an initiation on lifting, which arc locally fuses the bottom end of the radially inner (lower) pin part (13) as well as the roll surface (12). Thereafter, the lifting mechanism of the stud welding gun is automatically cut off and the two part pin is plunged into the liquid weld pool by spring pressure, by which means a homogeneous solid connection is produced between the roll surface (12) and the nub pin, the latter of which exhibits a long potential service life as a consequence of the protective radially outer pin part (14) of high hardness. The hard material of the radially outer pin part (14) here has a hardness of more than 52 HRC (Rockwell C hardness zest), in particular more than 58 HRC.

The height of the pins protruding radially outward from the roll surface (12) is approximately greater than 5 mm, for example 8 to 10 mm, for a pin diameter of for example 15 mm. Adjacent nub pins are welded on at such a close interval from one another, for example smaller than about 40 mm that the interstices or pockets formed between the pins in the region of the roll surface (12) are so narrow that these interstices or pockets (17) between the pins are filled, during attrition size reduction operation of the press roll, with one and the same compressed fine-grained but highly compacted material, which has gone through prior attrition size reduction. The material remaining in these pockets during the revolutions of the roll, that is, feed material pressed from outside into the interstices or pockets (17) between the nub pins and remaining there forms an ideal autogenous wear protection. Furthermore, in case of damage or wear to nub pins, the individual two-part nub pins, which inherently guarantee a long potential service life, can be replaced with new prefabricated two-part nub pins a trouble-free fashion by use of a stud welding gun.

What is claimed is:

1. A high-pressure roll press for the size reduction of granular material comprising:

a pair of counter-rotatable rolls each having a roll surface (12) and a plurality of outwardly projecting cylindrical nub pins welded onto said roll surface (12) at predetermined intervals from one another to form pockets (17) for the accommodation of compacted fine granular material, each of said nub pins including a radially inner cylindrical pin part (13) of easily weldable material, said radially inner part (13) being welded to said roll surface (12) and a radially outer cylindrical pin part (14) protectively covering said inner pin part (13), said radially outer pin part (14) being materially bonded to said radially inner pin part (13) and consisting of a material substantially harder than said easily weldable material of said radially inner pin part (14), said nub pins extending radially from said roll surface (12) to a height greater than approximately 5 mm and said predetermined intervals being smaller than approximately 40 mm.

2. The roll press of claim 1 wherein said radially outer pin part (14) consists of a sintered hard alloy.

3. The roll press of claim 1 wherein said radially outer pin part (14) consists of ceramic material.

4. The roll press of claim 1 wherein said radially outer pin part (14) consists of hard surface weld material.

5. The roll press of claim 1 wherein said hard material of the radially outer pin part (14) has a hardness of more than 58 HRC (Rockwell C hardness test).

6. The roll press of claim 1 wherein said radially outer pin part (14) is friction welded to said radially inner pin part (13).

7. The roll press of claim 1, wherein said radially outer pin part (14) is materially bonded to said radially inner pin part (13) by arc welding.

8. The roll press of claim 1 wherein said radially outer pin part (14) is materially bonded to said radially inner pin part (13) by explosive weld cladding.

9. The roll press of claim 1 wherein said radially outer pin part (14) is fabricated by powder-metallurgical methods and sintered onto said radially inner pin part (13).

10. The roll press of claim 1 wherein said radially outer pin part (14) and said radially inner pin part (13) are fabricated separately powder-metallurgical methods and then sintered together.

11. The roll press of claim 1 wherein said radially outer pin part (14) and said radially inner pin part (13) are fabricated jointly by powder-metallurgical methods whereby said parts are sintered together.

12. The roll press of claim 1 wherein said radially outer pin part (14) and said radially inner pin part (13) are a prefabricated unit.

13. The roll press of claim 1 and further comprising a roll body (10) and a roll shell (11) removably secured to said roll body (10), said roll shell (11) being a riding ring presenting said roll surface (12) to which said nub pins are welded.

* * * * *